US009873036B2

(12) United States Patent
Gruber

(10) Patent No.: US 9,873,036 B2
(45) Date of Patent: Jan. 23, 2018

(54) MODULAR POLYHEDRAL OBJECT

(71) Applicant: CVASSO GMBH, München (DE)

(72) Inventor: Fritz Gruber, München (DE)

(73) Assignee: CVASSO GMBH, München (DE)

( * ) Notice: Subject to any disclaimer, the term of this patent is extended or adjusted under 35 U.S.C. 154(b) by 0 days.

(21) Appl. No.: 14/890,362

(22) PCT Filed: May 7, 2014

(86) PCT No.: PCT/EP2014/001227
§ 371 (c)(1),
(2) Date: Nov. 10, 2015

(87) PCT Pub. No.: WO2014/183848
PCT Pub. Date: Nov. 20, 2014

(65) Prior Publication Data

US 2016/0129340 A1 May 12, 2016

(30) Foreign Application Priority Data

| | | |
|---|---|---|
| May 15, 2013 | (DE) | 10 2013 209 031 |
| Aug. 23, 2013 | (DE) | 10 2013 014 130 |
| Apr. 11, 2014 | (DE) | 10 2014 005 386 |

(51) Int. Cl.
*A63H 33/04* (2006.01)
*A63F 9/12* (2006.01)
(Continued)

(52) U.S. Cl.
CPC ..... *A63F 9/12* (2013.01); *A63F 9/1204* (2013.01); *A63F 9/1252* (2013.01); *A63H 33/04* (2013.01); *A63H 33/06* (2013.01); *A63H 33/14* (2013.01)

(58) Field of Classification Search
CPC ..... A63F 9/12; A63F 9/1204; A63H 33/04; A63H 33/06; A63H 33/14
(Continued)

(56) References Cited

U.S. PATENT DOCUMENTS

| | | | | |
|---|---|---|---|---|
| 284,037 A * | 8/1883 | McCleary | ..... | A63F 9/12 273/156 |
| 487,063 A * | 11/1892 | Bailey | ..... | A63F 9/12 273/156 |

(Continued)

FOREIGN PATENT DOCUMENTS

| | | |
|---|---|---|
| GB | 2 307 866 | 6/1997 |
| KR | 2012 0044102 | 5/2012 |

OTHER PUBLICATIONS

International Search Report issued by the European Patent Office in International Application PCT/EP2014/001227.

*Primary Examiner* — Alexander Niconovich
(74) *Attorney, Agent, or Firm* — Henry M. Feiereisen LLC

(57) ABSTRACT

A modular polyhedral object having at least four external faces which each have in the assembled state a different form and/or color design, is formed from several individual building blocks that each forms a part of the form or color design of each external face. The building blocks are joined together loosely or with releasable connecting means, wherein the building blocks of each module have at least four differently designed side faces. A form-congruent assembly of the object is created by arranging the individual building blocks so as to produce matching external faces on each side of the object, as well as to produce matching respective opposing side faces of the building blocks inside the object with vertically and horizontally matching coded
(Continued)

pairs. A modular polyhedral cube-shaped object with at least five differently designed side faces is also described.

11 Claims, 10 Drawing Sheets

(51) Int. Cl.
*A63H 33/06* (2006.01)
*A63H 33/14* (2006.01)

(58) Field of Classification Search
USPC ..... 273/153 R, 156, 157 R; 434/403; 446/108, 120, 122, 124, 115
See application file for complete search history.

(56) References Cited

U.S. PATENT DOCUMENTS 3,672,681 A * 6/1972 Wolf ..... A63F 9/12 273/157 R
4,003,144 A * 1/1977 Maddestra ..... A63F 9/0098 434/403
4,210,333 A * 7/1980 Shanin ..... A63F 9/1204 273/157 R
4,334,871 A * 6/1982 Roane ..... A63H 33/046 434/211
4,494,756 A * 1/1985 Winer ..... A63F 3/0415 273/156
4,852,878 A * 8/1989 Merrill ..... A63F 9/1204 273/146
5,249,966 A * 10/1993 Hiigli ..... G09B 23/04 434/211
5,427,375 A * 6/1995 Breckwoldt ..... A63F 9/083 273/146
5,785,319 A * 7/1998 Frauhiger ..... A63F 9/1204 273/157 R
5,799,943 A * 9/1998 Morgan ..... A63F 3/0423 273/160
5,921,548 A * 7/1999 Goldberg ..... A63F 9/34 273/156
6,152,797 A * 11/2000 David ..... A63H 33/08 434/403
6,164,649 A * 12/2000 Perkitny ..... A63F 9/12 273/156
6,422,560 B1 * 7/2002 Harbaugh ..... A63F 9/1204 273/153 S
7,785,179 B2 * 8/2010 Ionescu ..... A63F 3/0421 463/9
8,157,608 B1 * 4/2012 Stapleton ..... A63H 33/08 273/153 P
8,727,351 B2 * 5/2014 Agamawi ..... A63F 9/0869 273/155
8,757,621 B2 * 6/2014 Harris ..... A63F 3/00533 273/256
2007/0108701 A1 * 5/2007 Gu ..... A63F 9/1204 273/153 R

* cited by examiner

MODULAR POLYHEDRAL OBJECT

CROSS-REFERENCES TO RELATED APPLICATIONS

This application is the U.S. National Stage of International Application No. PCT/EP2014/001227, filed May 7, 2014, which designated the United States and has been published as International Publication No. WO 2014/183848 and which claims the priority of the following German Patent Applications: Serial No. 10 2013 209 031.5, filed May 15, 2013; Serial No. 10 2013 014 130.3, filed Aug. 23, 2013, and Serial No. 10 2014 005 386.4, filed Apr. 11, 2014, pursuant to 35 U.S.C. 119(a)-(d).

BACKGROUND OF THE INVENTION

The invention relates to a modular polyhedral object, preferably in the form of a rectangular body, a prism or a cube, with at least four outer faces in the assembled state, with each face having a different form and/or color design.

Such objects are composed of a plurality of individual building blocks that can be assembled in different ways and form in the assembled state of the object in each case a part of the form and/or color design of each outer face of the object. The object of the invention is thus assembled in various ways essentially from individual building blocks that also have a polyhedral shape. When the individual building blocks are assembled as intended to form the entire object, the outer faces have each a uniform layout, for example in the form of a color design, a motif or symbols.

Such modular objects are used, for example, for training the spatial imagination. However, such objects may also be used as a three-dimensional visualization medium to variably display contents on the respective outer faces of the modular object in three dimensions. Such objects are known hitherto, for example, in the form of images cubes consisting of single, square building blocks, each depicting a part of an overall motif and reproducing in a particular state of assembly a complete pattern. Another type of such cube-shaped objects are the so-called rotating cubes, wherein individual cube-shaped blocks having different external finishes are coupled internally via a special mechanism so that they have, despite their adjustability, always a fixed interconnection as a whole. In such known three-dimensional systems composed of cube-shaped building blocks, the form of their assembly has limited variability, and only on the outer sides result uniform configurations or content of the outer faces when the individual cube-shaped building blocks are correctly assembled or rotated.

SUMMARY OF THE INVENTION

It is an object of the present invention to provide a modular polyhedral object composed of individual building blocks, which offers through its design and form new possible applications of such multi-part modular objects. The object of the invention is to enable a higher degree of complexity and a greater variability than previous objects of this type and a rather simple construction of individual building blocks.

This object is attained with a modular cube-shaped object which will be described as a preferred, but non-limiting example.

The modular object in accordance with the invention is constructed from a plurality of individual building blocks of the same size and design and has in the assembled state at least four outer faces with respective different form and/or color, wherein the individual building blocks each form a part of the respective design and/or color of each outer face. The object can be variably assembled loosely or with detachable connection means into a complete object. The individual building blocks of this module within the object have at least four differently designed side faces so as to result, with form-congruent assembly of the object, both in consistently formed matching outer faces on each side of the object, and in matching opposing side faces of the respective building blocks inside the object.

In a cube-shaped object according to the invention, the building blocks are loose or can be joined together by way of detachable connection means, wherein the individual building blocks of each module within the cube-shaped object include at least five differently formed side faces resulting in, with a form-congruent assembly of the cube-shaped object, both matching outer faces on each side of the cube-shaped object and respective matching opposing side faces inside the cube-shaped object of the building blocks.

The individual building blocks can thus be assembled in various ways, wherein the uniform format of outer faces of the object can be produced only with a correct, form-congruent assembly of the building blocks. The differently designed or formed side faces of the individual building blocks are hence both a respective part of the design of the outer faces of the object as well as a coding for the assembly of the individual building blocks for the correct, form-congruent construction of modular polyhedral object. According to the invention, respective interior side faces of the building blocks are always adjacent to correspondingly shaped and designed side faces of each adjacent building block. The design and form of the individual building blocks of the object of the invention is selected so that a matching design of the side faces of abutting building blocks exists in the interior as well as that a uniform form of the design of the entire outer face is present for each side of the object. This measure and the special design of the individual building blocks for the construction of the object provide high complexity despite using relatively simple means. The coding for a correct assembly of the object is achieved by the different individual designs of the side faces which at the same time form a part of the overall design of the outer face of the correctly assembled object. Each type of the design of the side faces of the building blocks is quasi also the connecting means for the construction of the object. The construction of the individual side faces of the building blocks may be, for example, a color scheme with or without symbols.

The design of the side faces of the individual building blocks can also be a part of an overall pictorial motif that in conjunction with the associated building blocks of each side of the object can form an overall motif. Alternatively, the respective different design of the side faces of the building blocks may also be formed with relief-like shapes, i.e. as a flat face. However, this is not limiting, and the side faces of the individual building blocks may also be designed with other forms of coding, as long as different, uniform markings can result for each of the outer faces of the entire object and as long as individual building blocks are constructed with, according to the present invention, at least four, preferably five differently shaped or formed side faces.

For the correct assembly of the object, in which the respective abutting side faces of the building blocks in the interior match and the correct form of each outer face of the entire object is obtained, both the visible outer faces and the horizontal and vertical layers between the individual building blocks in the interior must be considered for the assembly. Therefore, a kind of three-dimensional coding of the side faces of the building blocks in several layers in both the vertical direction and in horizontal direction as well as outside and in the interior of the object is provided for the assembly. Such a modular polyhedral object can therefore be used not only to train spatial visualization and imagination. This approach also significantly increases the number of possibilities for assembling the individual building blocks, while only a single correct structure of the object is possible that is defined by the coding of the side faces. Thus, since not only the designs on the outer faces of the overall object match, but also the individual interior horizontal and vertical layers, the possibilities of three-dimensional visualization of content and motifs are increased. For example, for an object from a total of twenty-seven individual building blocks, predefined designs or images can already be reproduced on all sides with nine building blocks of a layer.

According to an advantageous embodiment of the invention, each individual building block of the object has at least four, five, or six different embodiments of side faces. In other words, the individual block is provided with various side faces such that at least four different types of side faces exist in each building block of a modularly configurable object.

Experiments and investigations of the inventor related to the design of the individual building blocks have surprisingly shown that although a very large number of possibilities exist for assembly of the individual building blocks, the predefined match of the interior opposing side faces and the uniform form of each of the outer faces of the entire object is obtained only with a single type of assembly. Only a single type of assembly from the plurality of types of assembly of the individual building blocks is correct, which is to be performed on the basis of codings which represent a kind of means for the interconnecting of the building blocks.

According to another advantageous embodiment of the invention, each building block within the object has a unique form due to its differently designed sides. Each of the individual building blocks is therefore unique and has no equivalent in another building block of the same object. A high versatility is achieved despite the basically simple design of the object and its building blocks. The object can be correctly assembled, for example as a three-dimensional puzzle, only with high concentration and by considering all side faces of the individual building blocks, both inside and outside.

According to another advantageous embodiment of the invention, the different designs of the side faces of the building blocks are implemented by way of a combined color and form design. Alternatively, only one color design or one form may be used as a characteristic feature for the respective side faces of the building blocks. The characteristic feature or design of the side faces is also possible by way of symbols or logos or other similar codes such relief-like faces, as long as an association of a correct assembly with matching side faces of respective abutting building blocks is possible and different designs or contents are achieved in a form-congruent assembly on the respective sides of the object as a whole. A combined color and form design of the side faces enhances the design options for the production of the object, and for example colored motifs may also be realized as a form of visualization on the outer faces of the object, which arise automatically from the individual designs of the side faces of the building blocks for the correct predefined structure. For example, at least four outer faces may be realized with a symmetrical, single color design, while the other outer faces may carry a picture on a product or a national flag. The latter is produced and will be visible only with the correct form-congruent assembly of the building blocks based on the coding according to the invention.

According to another advantageous embodiment of the invention, the different embodiments of the respective side faces of the building blocks have a number or letter coding, which can be used either alone or in addition to a color or design-defining motif. Coding by numbers or letters has the advantage that, for example, the degree of difficulty is further increased when used, for example, as training material to perform the correct assembly. Again, the object is further characterized according to the invention in that, with the correct form-congruent assembly of the object, the individual codes on the outer faces of the object are uniform and the mutually facing side faces of the building blocks in the interior each have the same code (letter or number).

According to another advantageous embodiment of the invention, the respective different form and/or color design of the outer face produces a puzzle-like motif in the predefined state of a correct, form-congruent assembly of the individual building blocks of the object. The object thus shows on its outer sides a complete motif, for example, an image of a product or article, which is obtained only with a distinctive, correct assembly of building blocks. The desired motif on the outer sides is not obtained with an incorrect assembly of the individual building blocks, i.e. when the coding by the respective side faces of the building blocks is not properly accounted for. It can be detected immediately whether or not the match of opposite forms of side faces in the interior was maintained, because the outer motifs on the outer faces of the object would otherwise not be obtained. In such an embodiment, the invention may be used, for example, as a multi-dimensional presentation object for products with both an external and an internal presentation, or as a learning tool or a training tool for practicing spatial perception. The complete three-dimensionality of the designs makes the assembly of the forms of the side faces particularly challenging and requires high concentration from the user, when the object is used, for example, as a puzzle or for competitions. Even when the object is used repeatedly, the degree of complexity remains difficult due to the special design of the individual building blocks that have each at least five different individualized side faces.

According to another advantageous embodiment of the invention, the different embodiments in the design of the side faces of the building blocks are provided with an asymmetric motif in relation to the building block. In contrast to symmetrical motifs or design features on the side faces of the building blocks for the assembly and the generation of the outer faces, an asymmetric design has a lower degree of complexity. Such an embodiment requires, in addition to considering the (interior) codes also the correct orientation of the respective asymmetric symbols, in order to be correctly aligned with respect to the symbols on each side face of the adjacent building blocks of the object. This can be used to provide instructions for the correct assembly of the object.

According to another advantageous embodiment of the invention, the modular polyhedral object is constructed from 16, 27 building blocks, 64 building blocks, 125 individual building blocks, 216 or 512 individual building blocks. The 27-block system is composed of three individual building blocks arranged along the width, depth and height, respectively, and commensurately, the 64-block system is composed of four building blocks, and the 125-block system is composed of five building blocks in each dimension. The greater the number of individual building blocks, the higher the level of difficulty of the assembly, requiring an increasingly more demanding spatial imagination to assemble the object correctly. Alternatively, according to the invention, objects can be produced with 216 or 512 individual building blocks. The variability and complexity of the modular object is then accordingly higher.

For this reason, there is also a version with 32 or 48 building blocks.

According to another advantageous embodiment of the invention, the different embodiments of the side faces of the individual building blocks are formed with respective interlocking depressions and elevations having at least four different forms. Alternatively or in addition to a color design or a design of a form or a symbol, additional coding for assembling the building blocks into the object can be provided with the depressions and elevations. Furthermore, a certain cohesion of the building blocks can be attained with the slight depressions and elevations on the side faces of the building blocks already during assembly, so that the object already holds together even without additional (alternative) connecting means.

According to another advantageous embodiment of the invention, the building blocks of each cube-shaped module have releasable connecting means. Releasable connecting means can be implemented, for example, with plug-in connections, adhesive connections or the like, as long as the building blocks can be variably assembled, i.e. with their different sides aligned differently to each other, and then disassembled again. The releasable connecting means have the advantage that the object has greater stability even without outer covers or the like. They also help holding the object together for transport and after assembly has been completed.

BRIEF DESCRIPTION OF THE DRAWING

Further advantages and features of the invention will be explained in conjunction with the accompanying drawings with reference to the description of several exemplary embodiments. In the drawing, reference will be made, without any limitation, to an exemplary embodiment of a modular polyhedral object in the form of a cube-shaped object. The drawings show in.

DETAILED DESCRIPTION OF PREFERRED EMBODIMENTS

Figure 1:
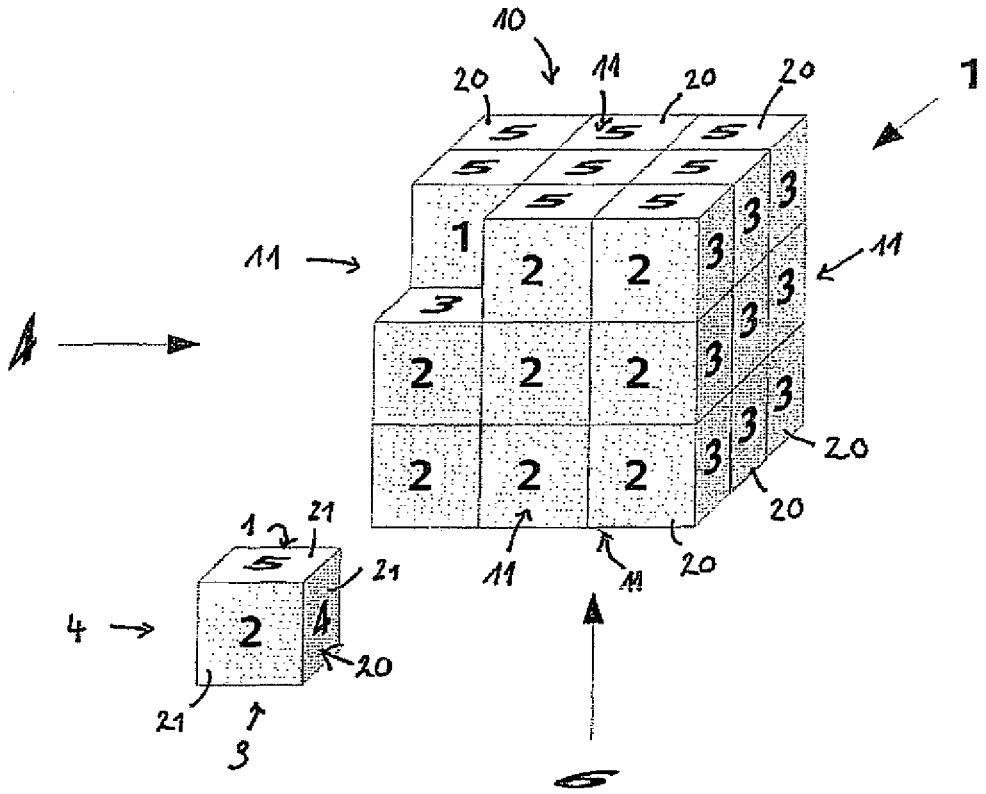
FIG. 1 a perspective view of a first exemplary embodiment of a cube-shaped object for illustrating the principle of the structure and the form of the building blocks.
Figure 4A:
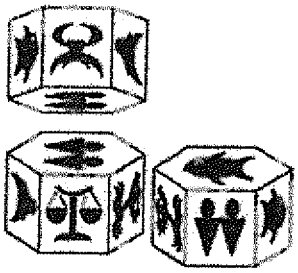
FIGS. 4*a* and 4*b* exemplary illustrations of variations of side faces of the building blocks.
Figure 4B:
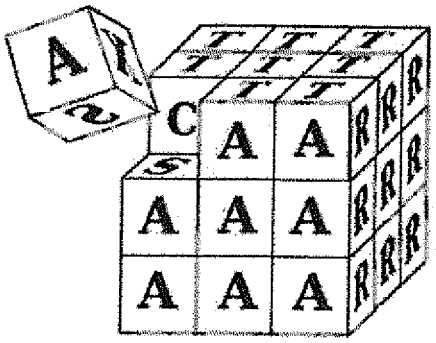

FIG. 1 shows in a perspective view of a first exemplary embodiment of a cube-shaped object 10 consisting of twenty-seven individual building blocks 20. The building blocks 20 are in the assembled state of the cube-shaped object 10 arranged three in width, three in depth and three in height. Each of the building blocks 20 is provided with at least four differently designed side faces 21, which are in this exemplary embodiment and for purposes of ease of explanation of the principle of the invention realized herein in the form of numbers as the connecting means. The numbers as possible embodiments of the side faces 21 of the building blocks 20 are, however, merely to be understood only as examples, and other motifs or color designs or design forms of the side faces 21 of building blocks 20, such as geometric forms, simple colors or pictorial designs may be used for this purpose, as shown by way of example in FIGS. 4*a* and 4*b* . In the correctly assembled predefined state of the cube-shaped object 10, the cube-shaped object 10 has on each of its six outer sides a respective uniform design of the outer face 11; for example, in the example of FIG. 1, on the top face the continuous representation with the number five and on the front face with the number two. The differently formed side faces 21 of the individual building blocks 20 thus represent both connecting means for constructing the cube-shaped object 10 as well as in the correct, i.e. form-congruent structure of the cube-shaped object 10, a part of the respective form or design of the entire outer faces 11. The design of the individual building blocks 20 thus has a dual function, i.e. on the one hand, the visualization of the respective defined form of the outer faces 11 as well as coding for the respective assembly of adjacent building blocks 20 of a respective cube-shaped object 10.

Here, each building block 20 in this example is designed with at least five different side faces 21 and is in this embodiment also a unique feature within each cube-shaped object 10. In other words, in this cube-shaped object 10 consisting of twenty-seven individual building blocks 20, the specific form and design of each building block 20 appear only once. The design of the individual building blocks 20 is selected such that with a correct, form-congruent assembly of the cube-shaped object, not only are uniform outer faces 11 of the cube-shaped object 10 formed on all six sides (see. FIG. 1), but the design of the side faces 21 that each face adjacent building blocks 20 or abut each other also matches in the interior. This is illustrated in the FIG. 1 by way of a corner building block 20 that has been removed. The back side of the building block 20 illustrated in FIG. 1 has, for example, the number one, while the bottom side has the number three corresponding to the adjacent building blocks 20. According to the invention, a specific embodiment of the respective individual building blocks 20 of the modular cube-shaped object 10 is thus realized wherein not only similarities in the design or implementation of the side faces result, which together form the respective outer faces 11 of the cube-shaped object 10, but also of the abutting side faces 21 of each building block 20 disposed in the interior of the cube-shaped object 10. An embodiment with numbers is given here only an example to facilitate illustration of the principle of the invention. Other embodiments of the sides of the building blocks by way of designs, symbols, colors, or relief-like faces are also possible within the scope of the invention, as long as they allow for a kind of coding for the modular block-like assembly of the entire cube-shaped object. According to the invention, this produces not only a three-dimensional match of side faces of the building blocks 20 in the vertical and horizontal layers, but also design of the outer faces 11 of the cube-shaped object 10 on the outer six faces. This is achieved by forming each building block 20 of each cube-shaped object 10 in at least four and at most six different versions. This will be explained in more detail in conjunction with the other exemplary embodiments illustrated in FIGS. 2 through 3*d*.

Figure 2:
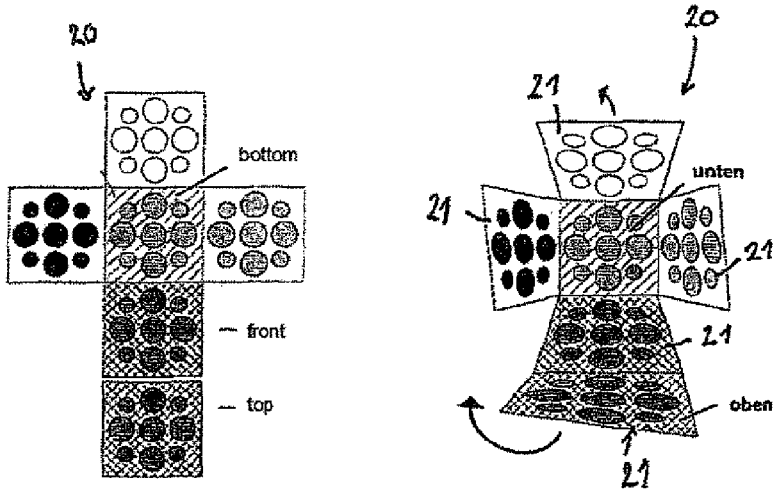
FIG. 2 a single building block of a second exemplary embodiment of a cube-shaped object in the form of a polyhedral net of a cube and a schematic three-dimensional view for explaining the polyhedral net of a cube.

FIG. 2 shows a building block 20 of a second exemplary embodiment of a cube-shaped object in the form of a polyhedral net and a partially three-dimensionally folded polyhedral net to illustrate the representations of the building blocks 20 of the cube-shaped systems in the form of polyhedral nets.

Figure 3:
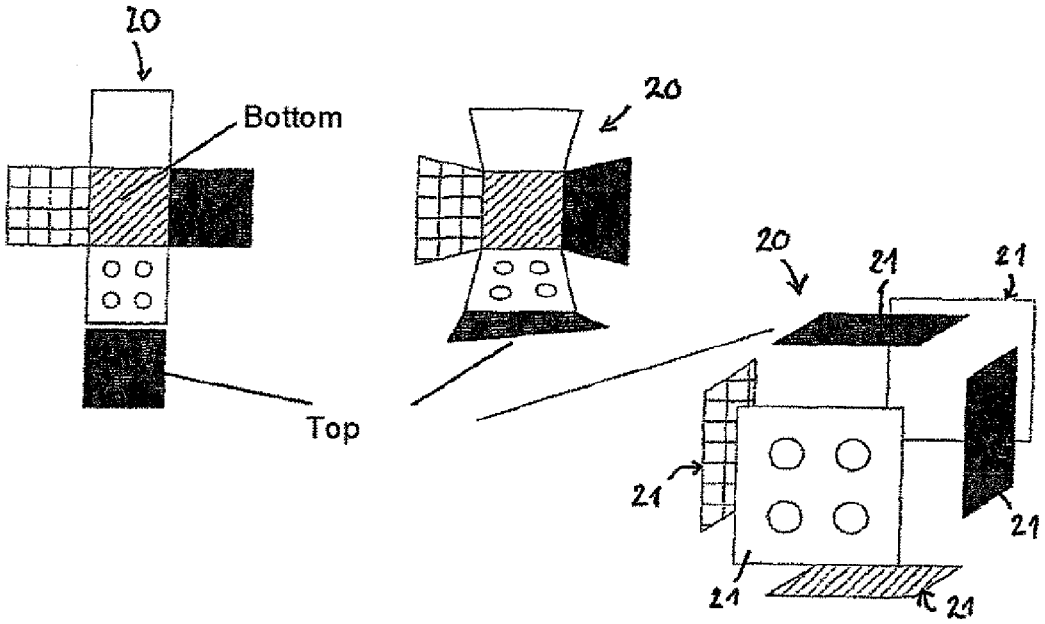
FIG. 3 a building block of a third exemplary embodiment of a cube-shaped object in the form of a polyhedral net of a cube and schematic three-dimensional representations to illustrate the form and design of the building block.

FIG. 3 shows a third embodiment of a possible form of building blocks 20 for an exemplary embodiment of a polyhedral net of a cube in corresponding representations as a polyhedral net (left hand side) and the three-dimensional composition of the individual side faces 21 of the building block 20, which are each formed with at least five different designs on the side faces 21. In the illustrations in the form of cubes crosses, the center square is always the bottom side face 21 and the bottom face is the respective side face 21 on the top side of the building block 20. The other four faces form the respective lateral side faces, i.e. rear, front, right and left side faces.

As can be clearly seen in FIGS. 2 and 3, the building block 20 of the cube-shaped object 10 is characterized by at least four different designs of side faces 21, i.e. only at least one form of a side face is repeated, in the example of FIG. 3 the top and right side faces 21. The building blocks 20 of the cube-shaped object are here regular squares and can be made for example of wood or another material that can be realized with different forms of side faces. The different forms of the side faces 21 of the building blocks 20 of each cube-shaped object 10 are preferably realized in the form of color designs or with motifs from pictures or with symbols. However, the side faces 21 may also differ in their form, as long as at least four differently formed side faces 21 are present in each building block 20. This specific different design of the individual side faces of the building blocks produces the modular cube-shaped object 10, as shown for example in the perspective view of FIG. 1. The individual forms of the exemplary embodiments according to FIGS. 2 and 3, i.e. the respective designs of their individual building blocks 20, will be described in the following based on the polyhedral net representations in the different layers of each cube-shaped object 10 of FIGS. 2*a* to 3*d*.

Figure 2A:
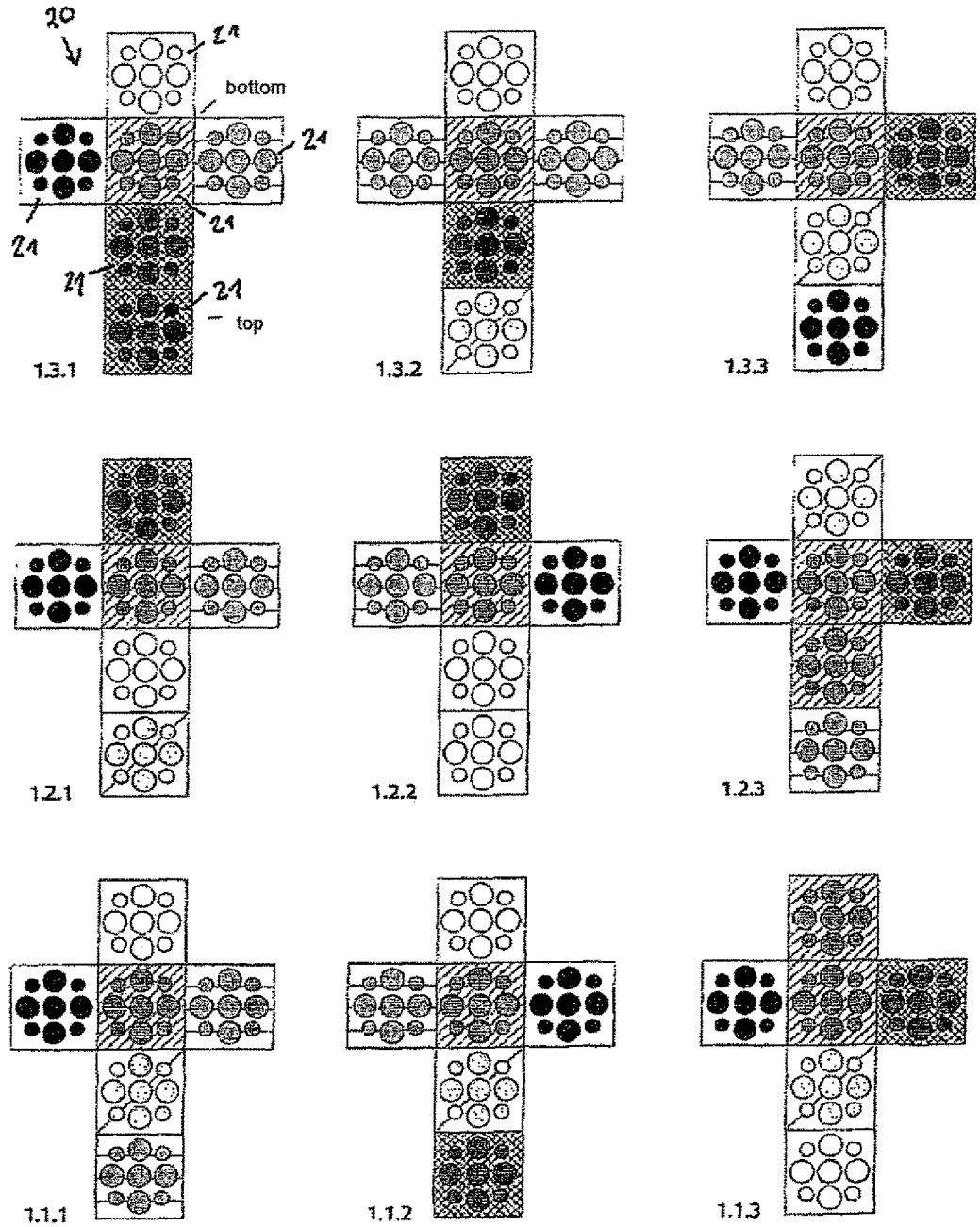
FIGS. 2*a* to 2*c* polyhedral net representations of the building blocks of an exemplary embodiment of a cube-shaped object with 27 individual building blocks in the three different layers according to the exemplary embodiment of FIG. 2.
Figure 2A:
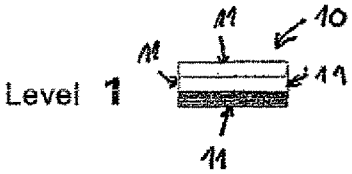
Figure 2B:
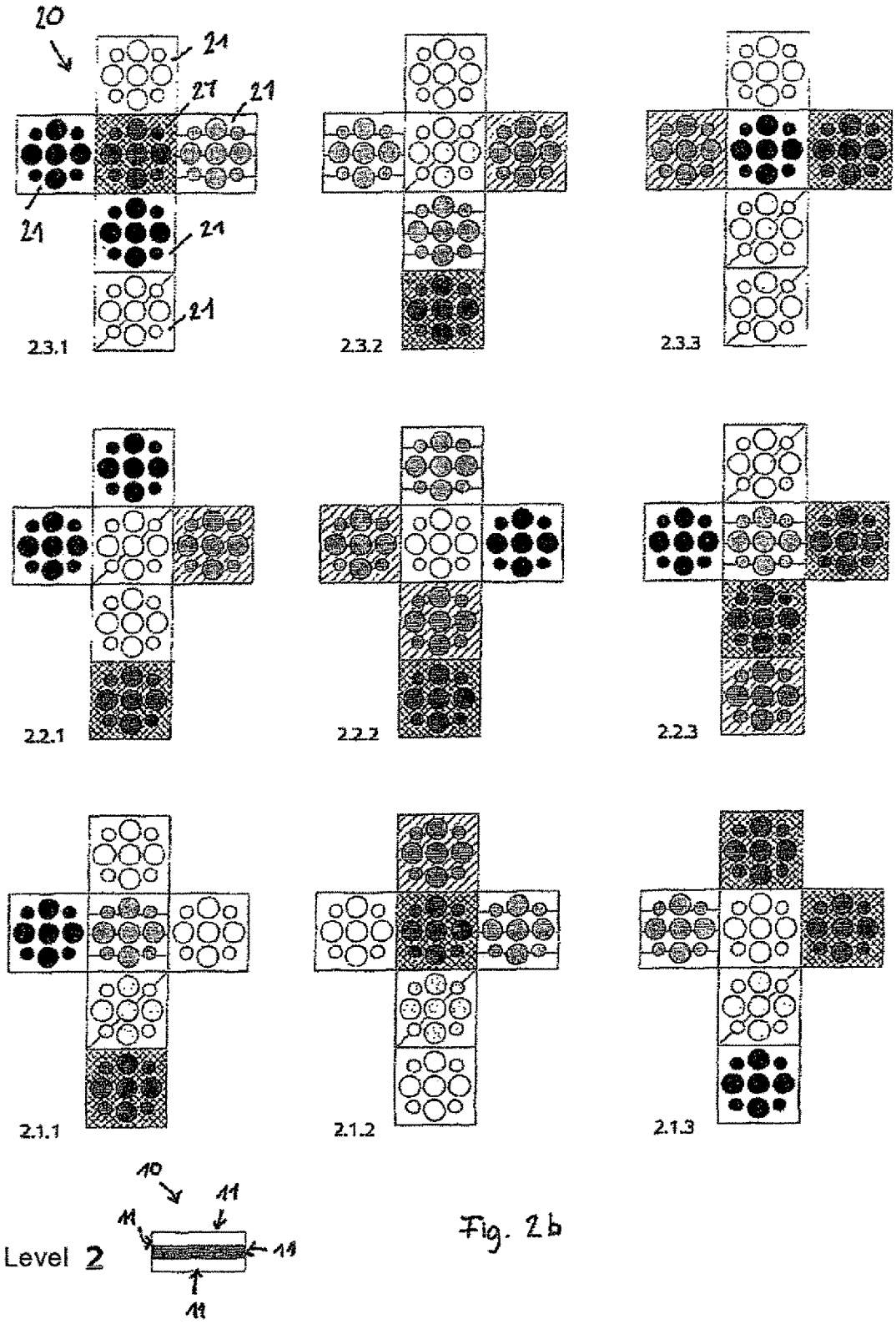
Figure 2C:
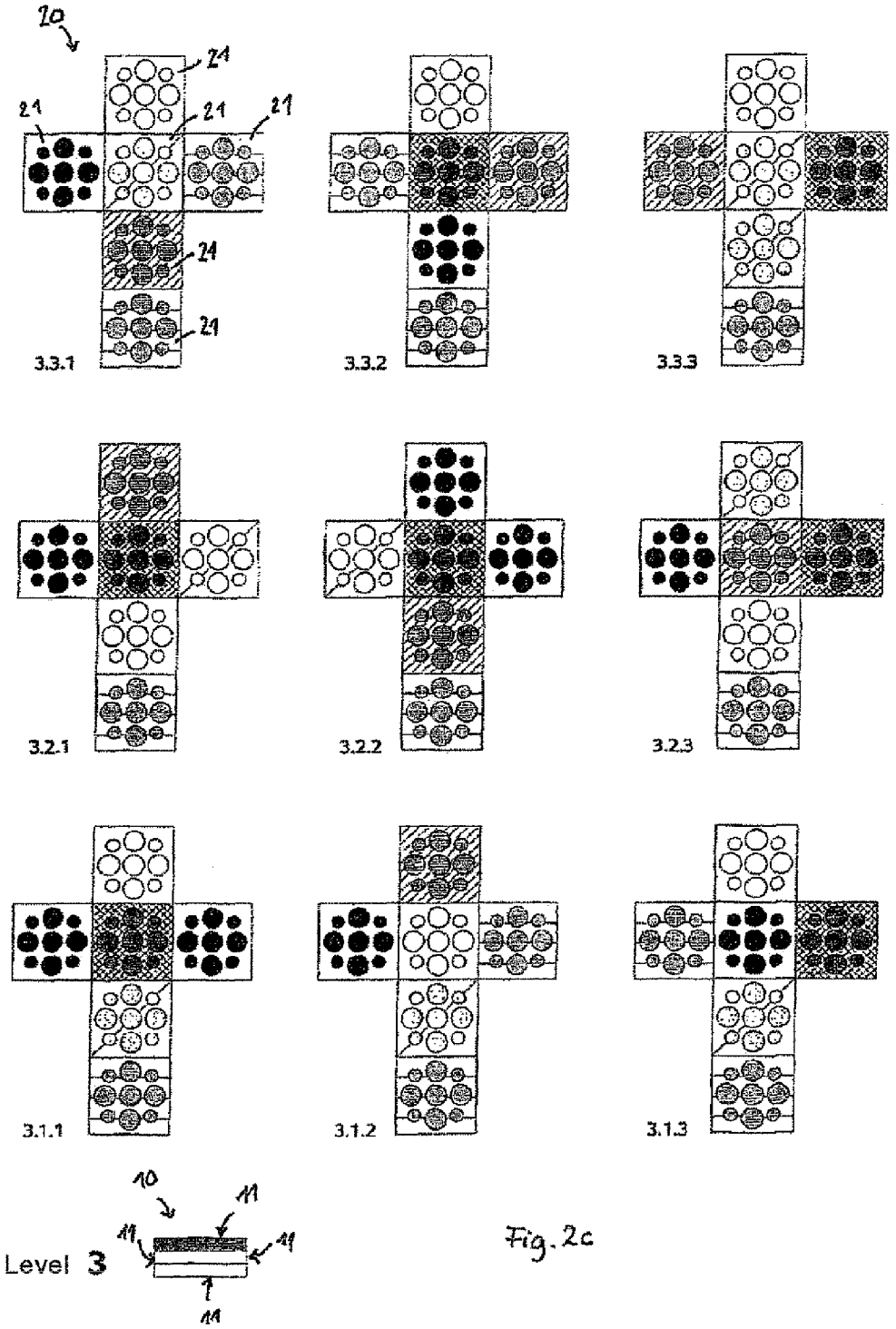

In FIG. 2*a*, the building blocks 20 of the lowest layer of one exemplary embodiment of a cube-shaped object 10 according to the invention are shown with twenty-seven individual building blocks 20. FIG. 2*b* shows the form of the individual building blocks 20 of the middle layer and the FIG. 2*c* shows the form of the individual building blocks 20 of the top layer of the building blocks of this exemplary embodiment. It can be seen from FIG. 2*a* that the building blocks 20 are realized such that they are identically constructed in the assembled state at the outer side faces 20 and the lower side (bottom). The center side face of each polyhedral net of a cube 1.1.1 to 1.3.3 is here realized identically with the points in the center gray area and diagonal hatching in all building blocks 20. Likewise, this is true for the polyhedral nets 1.3.1, 1.3.2 and 1.3.3 for the rear side face 21 (upper square with white points motif) as well as at the respective lateral side faces at the outer sides of the cube-shaped object 10, i.e. the left column and the right column of the polyhedral nets in FIG. 2*a*. The layer 2 and layer 3 of the cube-shaped object are similar, as shown in FIGS. 2*b* and 2*c*. Thus, the respective outer faces 11 of the cube-shaped object 10 are each implemented uniformly. The individual building blocks 20 are designed such that only matching forms of side faces face each other in the interior. For example, in FIG. 2*b*, the building block 2.2.2 with his black design will abut the likewise black design of the left side face 21 of the building block 2.2.3.

Figure 5:
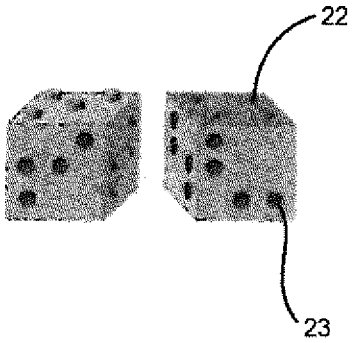
FIG. 5 an exemplary illustration of a connecting means for the assembly of the cube-shaped object.

This correspondence or match of respective abutting side faces 21 thus forms in the embodiment according to the invention a kind of coding for the three-dimensional assembly of the individual building blocks 20 of the cube-shaped object 10 in order to obtain uniform outer designs of the outer faces 11 of the finished modular cube-shaped object. The differently designed side faces 21 of the building block 20 thus represent a kind of connecting means for the assembly of the cube-shaped object, which can be implemented by way of a different design with motifs, colors, symbols or the like, but also by way of different forms. An example of connecting means is shown in FIG. 5, depicting elevations 22 and depressions 23 on the side faces 21.

While FIGS. 2, 2*a* to 2*c* show an embodiment of a cube-shaped object with twenty-seven individual building blocks 20, FIGS. 3, 3*a* to 3*d* show another exemplary embodiment of a cube-shaped object of the present invention 10 with sixty-four individual building blocks, i.e. with four layers and each having four individual building blocks arranged in depth, width and height of the assembled cube-shaped object. Unlike the previous embodiment, the individual side faces 21 of the differently designed building blocks 20 are here implemented in a different form, in order to explain that the type or form of the motifs or the color of the side faces are not important, but rather the fact that according to the invention at least four different side faces 21 are implemented on each individual building block 20. In this further embodiment shown in FIGS. 3*a* to 3*d*, the outer faces 11 of the entire cube-shaped object 10 as well as the opposing side faces 21 of the building blocks 20 in the interior have only matching forms of side faces 21.

Figure 3A:
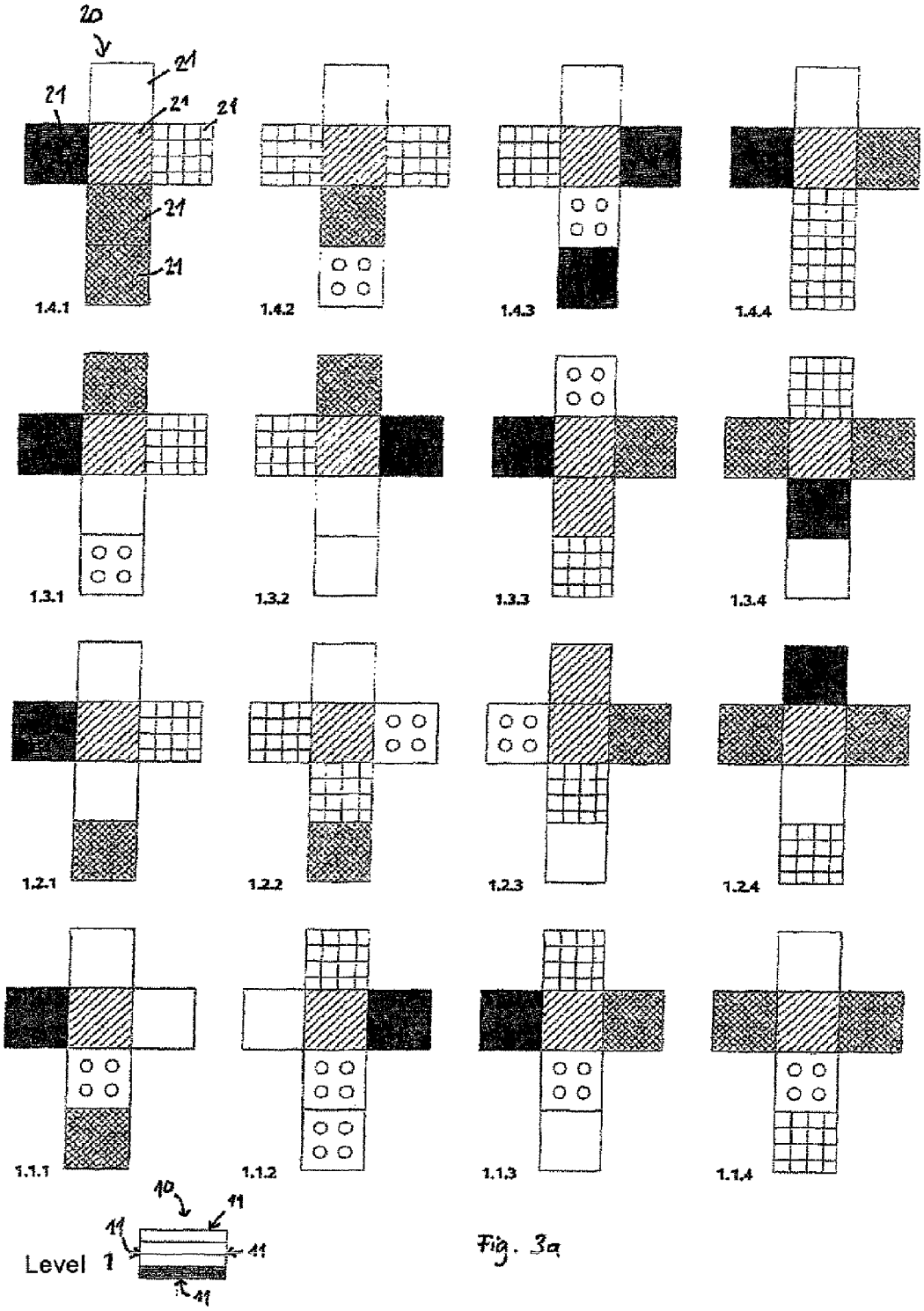
FIGS. 3*a* to 3*d* polyhedral net views of an object with 64 individual building blocks in the four different layers according to the exemplary embodiment of FIG. 3.
Figure 3B:
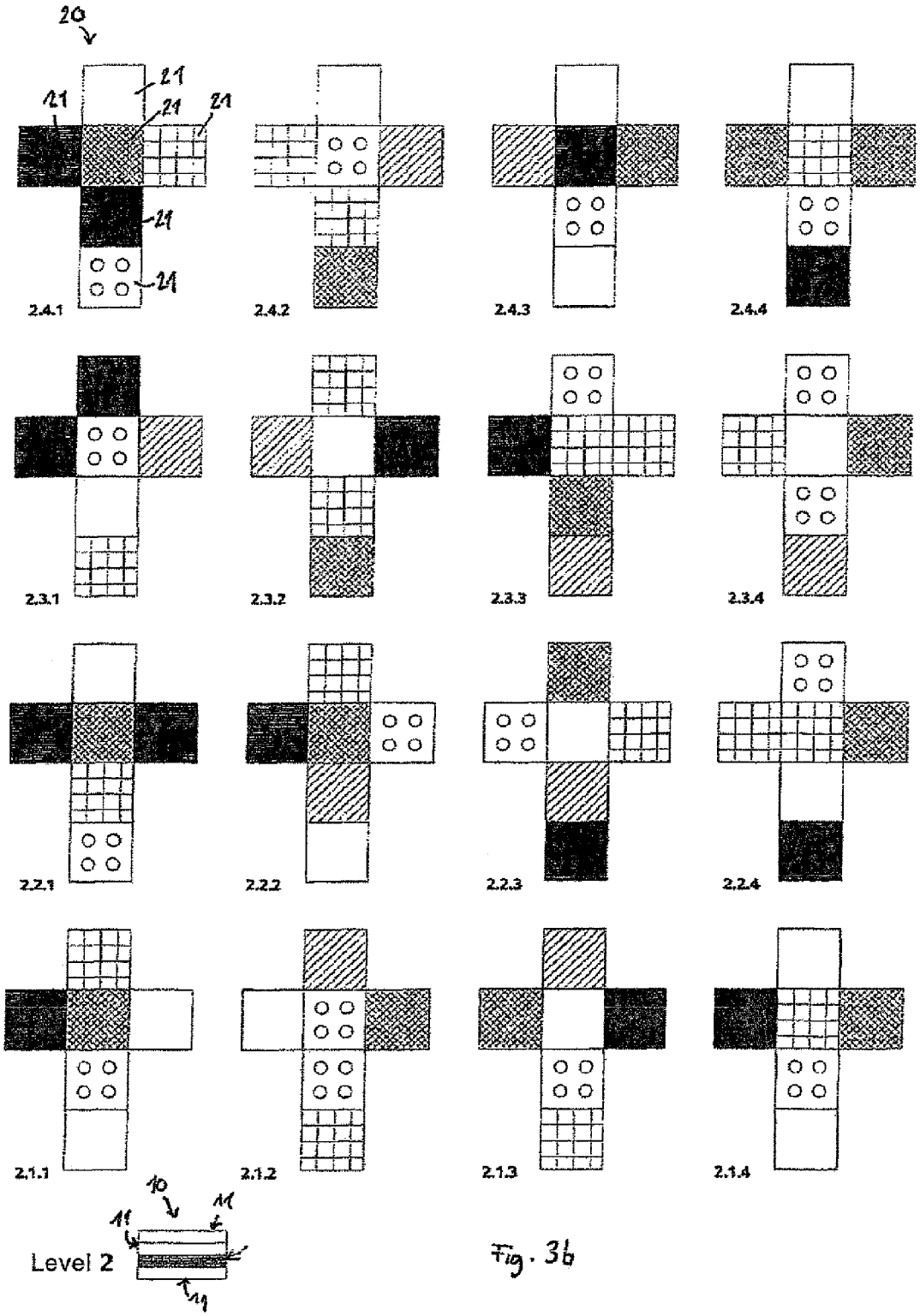
Figure 3C:
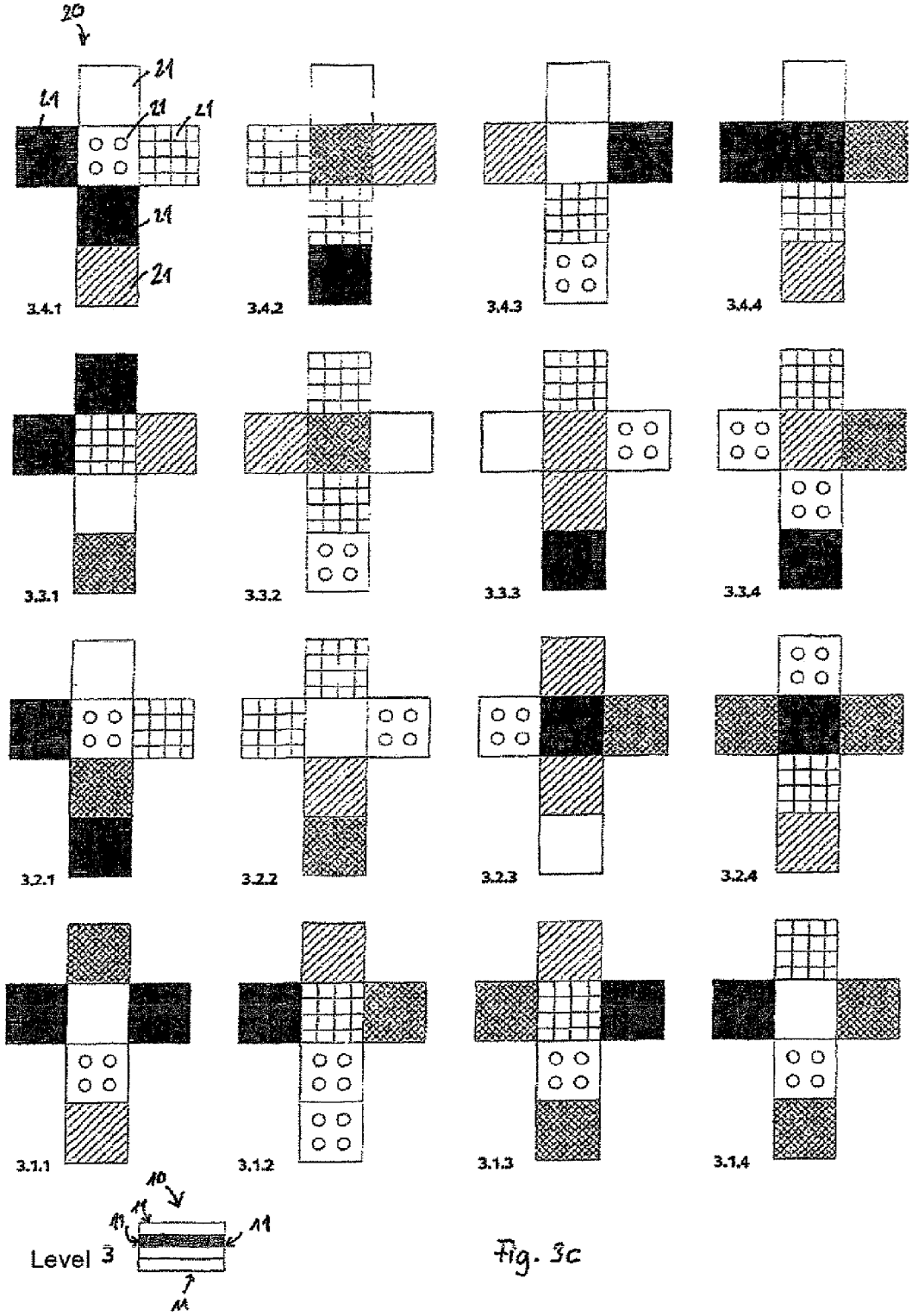
Figure 3D:
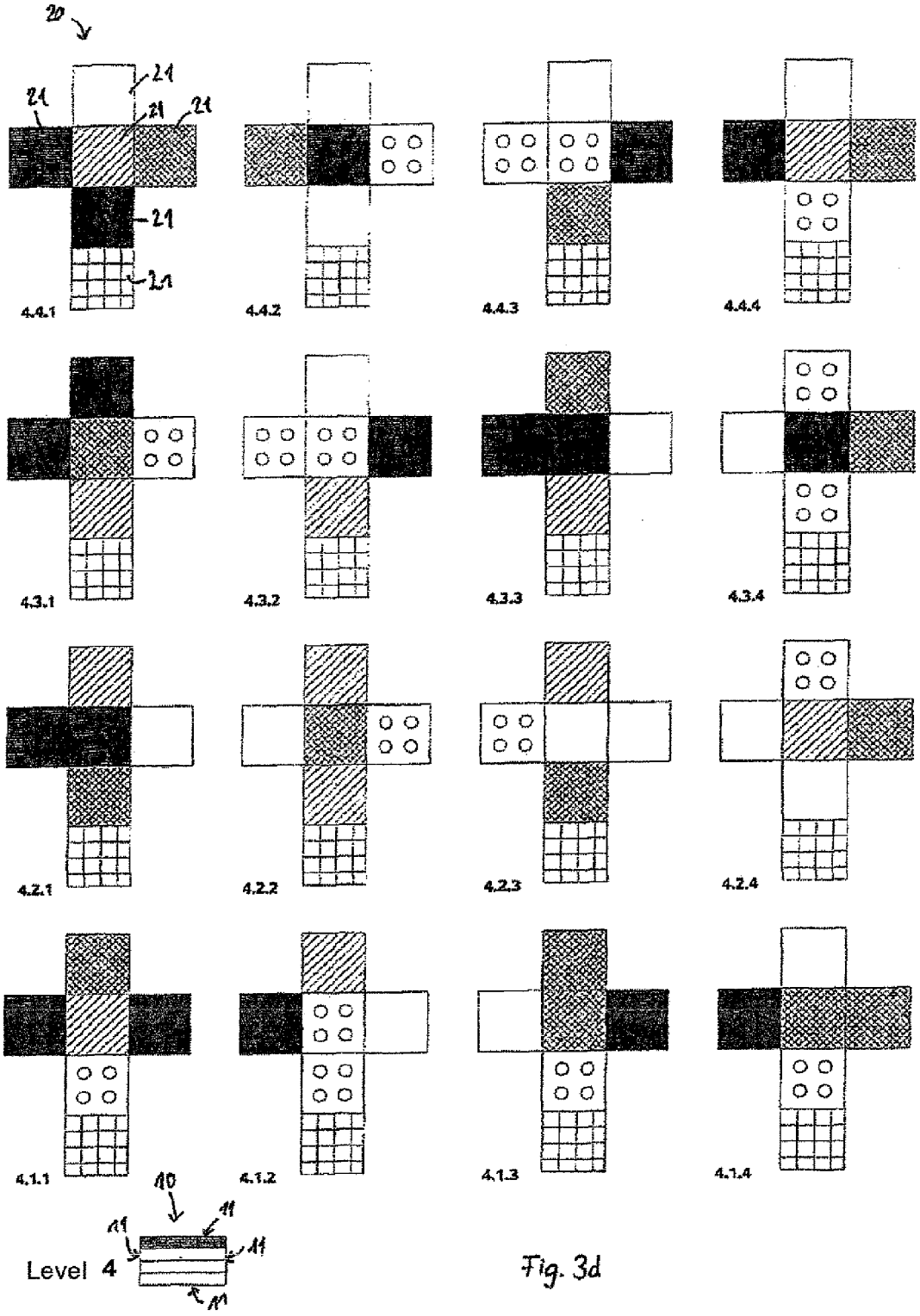

As clearly seen in FIG. 3*a*, the opposing side faces 21 of the cubes 1.1.1 and 1.1.2, are designed white, whereas the side faces of the cubes 1.2.1 and 1.2.2 disposed above have a checkered pattern. Here too, the different versions of the side faces 21 of the building blocks 20 realized with motifs, forms or colors form both the means for the predefined correct assembly of the cube-shaped object 10 as well as, in relation to the outer faces 11, a part or a building block of the uniform embodiment of the cube-shaped object 10 that forms the outer faces 11. The other three layers of the cube-shaped object constructed from sixty-four individual building blocks 20, which each represent a unique feature in this exemplary embodiment, are evident from the corresponding representations of the polyhedral nets in FIGS. 3*b*, 3*c* and 3*d*.

When the respective cube-shaped object 10 is assembled with its individual building blocks 20 in the pre-defined form of the composition (see. FIG. 1), all six outer faces 11 of the cube-shaped object 10 have different contents, representations or motifs, i.e. six different designs on all six sides of the cube-shaped object. Simultaneously, due to the special form and design of the individual building blocks 20, a coding of the assembly of the particular modular cube-shaped object 10 due to the respective structure of the side faces 21 of the building blocks 20 is provided, which is used in the proper construction and defines the composition of the building blocks 20. Advantageously, each building block 20 is unique, i.e. is different from any other building block 20 of a cube-shaped object 10 due to the at least five different side faces 21 per building block 20. The side faces 21 of the building blocks 20 of the cube-shaped object 10 thus match in each horizontal and each vertical inner layer. The respective outer faces 11 of the entire cube-shaped object 10 are also formed identically or with matching designs, whether by way of color coding, an alphanumeric identification or by way of pictorial motifs or partial motives that can be used for applications of the cube-shaped object 10 as a visualization medium or as a multi-dimensional display or the like. As an example, five of the outer faces 11 of the cube-shaped object 10 may be each realized in a same color, while the sixth outer face 11 in the form-congruent assembly, i.e. with a color matching structure formed in the interior, may for example have an image of a national flag. The latter would then be quasi the top side or front side of the finished cube-shaped object for visualization purposes.

The modular cube-shaped object 10 illustrated as an example is in particularly well suited as a device for training the spatial imagination. Due to the special design and construction of the individual building blocks 20, a three-dimensional spatial assembly of all six sides of each building block 20 can be consistently observed in order to obtain the predefined, correct form of the assembly of the cube-shaped object from the building blocks 20. Unlike previous conventional systems, such as the so-called rotary cubes, the form does not only match on the outer sides of the elements in the defined state, but the respective design of the interior side faces 21 must also always still be taken into account. The individual building blocks 20 according to the illustrated exemplary embodiments can be both loosely assembled in various ways as well as assembled by using detachable connection means which ensure easy assembly and a better grip of the building blocks 20 to one another. The illustrated embodiments relate to a cube-shaped object 10 with twenty-seven or sixty-four building blocks 20, respectively. However, a greater number of building blocks 20 may be provided, for example, one hundred twenty five or two hundred and sixteen, as long as the individual building blocks 20 and the outer faces 11 of the cube-shaped object are implemented with uniform cube-shaped forms that are prepared with at least four and at most six different designs on each side face 21.

The invention claimed is:

1. A modular polyhedral object having at least four external faces which each have in an assembled state a different form or color design, or both, the modular polyhedral object comprising:

a plurality of individual building blocks, with each building block forming a part of the form or color design of each external face, wherein the building blocks forming the modular polyhedral object are joined together loosely or with releasable connecting means, wherein the individual building blocks of each modular polyhedral object have at least four differently designed side faces, wherein a form-congruent assembly of the modular polyhedral object is created by arranging the individual building blocks so as to produce matching external faces on each side of the object, as well as to produce matching respective opposing side faces of the building blocks inside the modular polyhedral object with vertically and horizontally matching coded pairs, wherein each individual building block of the object has at least four, five or six differently shaped side faces, wherein each individual building block of the object has a unique form due to the differently designed side faces, wherein the differently designed side faces are composed of a combined color design and form design, wherein the differently designed side faces have a number coding or a letter coding, and wherein the respective different color design and form design of the external faces produce a motif assembled in form of a puzzle in a predefined state of a correct, form-congruent assembly of the individual building blocks of the polyhedral object.

2. The polyhedral object of claim 1, wherein the motif is asymmetrical in relation to the building block.

3. The polyhedral object of claim 1, wherein the polyhedral modular object is composed of 16, 27, 32, 48, 64, 125, 216 or 512 individual building blocks.

4. The polyhedral object of claim 1, wherein the color designs and form designs of the side faces of the building blocks are each formed with meshing depressions and elevations as the connecting means.

5. The polyhedral object of claim 1, wherein the releasable connecting means comprise connecting means selected from plug-in connections and adhesive connections.

6. The polyhedral object of claim 1, wherein the polyhedral modular object has a shape of a rectangular body, a prism or a cube.

7. A modular cube-shaped object having in an assembled state six outer faces of identical size, but of mutually different form or color design, the modular cube-shaped object comprising:

a plurality of individual cube-shaped building blocks that are configured to be joined together into the cube-shaped object loosely or with releasable connecting means, wherein the individual cube-shaped building blocks have an identical size and form each a part of the form or color design of each outer face, wherein the individual building blocks within the cube-shaped object have at least five differently designed side faces, and wherein, when the modular cube-shaped object is assembled in a form-congruent manner, each side of the modular cube-shaped object has matching outer faces and respective opposing side faces of the building blocks inside the modular cube-shaped object match, wherein each individual building block of the modular cube-shaped object has at least four, five or six differently shaped side faces, wherein each individual building block of the modular cube-shaped object has a unique form due to the differently designed side faces, wherein the differently designed side faces are composed of a combined color design and form design, wherein the differently designed side faces have a number coding or a letter coding, and wherein the respective different color design and form design of the outer faces produce a motif assembled in form of a puzzle in a predefined state of a correct, form-congruent assembly of the individual building blocks of the modular cube-shaped object.

8. The modular cube-shaped object of claim 7, wherein the motif is asymmetrical in relation to the building block.

9. The modular cube-shaped object of claim 7, wherein the modular cube-shaped object is composed of 16, 27, 32, 48, 64, 125, 216 or 512 individual building blocks.

10. The modular cube-shaped object of claim 7, wherein the color designs and form designs of the side faces of the building blocks are each formed with meshing depressions and elevations as the connecting means.

11. The modular cube-shaped object of claim 7, wherein the releasable connecting means comprise connecting means selected from plug-in connections and adhesive connections.

* * * * *